US008935861B2

(12) United States Patent
Baker et al.

(10) Patent No.: US 8,935,861 B2
(45) Date of Patent: Jan. 20, 2015

(54) ARTICLE OF FOOTWEAR ACCOMMODATING DIFFERENT FOOT SIZES

(75) Inventors: Brian D. Baker, Portland, OR (US); Blake Rhulen, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 962 days.

(21) Appl. No.: 12/541,600

(22) Filed: Aug. 14, 2009

(65) Prior Publication Data

US 2011/0035963 A1 Feb. 17, 2011

(51) Int. Cl.

| | |
|---|---|
| ***A43B 3/26*** | (2006.01) |
| ***A43B 5/02*** | (2006.01) |
| ***A43B 1/10*** | (2006.01) |
| ***A43B 1/00*** | (2006.01) |
| ***A43B 7/06*** | (2006.01) |
| ***A43B 7/14*** | (2006.01) |
| ***A43B 13/14*** | (2006.01) |
| ***A43B 13/22*** | (2006.01) |
| ***A43B 13/40*** | (2006.01) |
| ***A43C 15/16*** | (2006.01) |
| ***A43B 23/02*** | (2006.01) |

(52) U.S. Cl.

CPC ..... *A43B 1/10* (2013.01); *A43B 1/0018* (2013.01); *A43B 3/26* (2013.01); *A43B 5/02* (2013.01); *A43B 5/025* (2013.01); *A43B 7/06* (2013.01); *A43B 7/141* (2013.01); *A43B 7/1425* (2013.01); *A43B 13/141* (2013.01); *A43B 13/226* (2013.01); *A43B 13/40* (2013.01); *A43C 15/16* (2013.01); *A43B 23/027* (2013.01)

USPC ..... 36/97; 36/128

(58) Field of Classification Search

USPC ..... 36/3 A, 97, 114, 128, 133

See application file for complete search history.

(56) References Cited

U.S. PATENT DOCUMENTS

| | | | | |
|---|---|---|---|---|
| 1,773,127 | A | 8/1930 | Auster | |
| 2,930,149 | A * | 3/1960 | Hack et al. | 36/28 |
| 3,026,635 | A | 3/1962 | Slade | |
| 3,722,113 | A | 3/1973 | Birkenstock | |
| 4,075,772 | A * | 2/1978 | Sicurella | 36/43 |
| 4,095,353 | A | 6/1978 | Foldes | |
| 4,103,439 | A | 8/1978 | Abramson | |

(Continued)

FOREIGN PATENT DOCUMENTS

| | | |
|---|---|---|
| DE | 20 2006 009950 | 11/2007 |
| EP | 0875163 | 11/1998 |

(Continued)

OTHER PUBLICATIONS

The International Search Report and Written Opinion of the International Searching Authority, mailed Feb. 14, 2011 in International Application No. PCT/US2010/041911.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear comfortably accommodating different foot sizes is disclosed. The article comprises an upper, sole and integrally formed cleat members made of a monolithic material. In addition, the article can include an integrally formed internal cushioning system. The article further includes grooves and/or perforations that assist the footwear in stretching to accommodate different foot sizes.

19 Claims, 10 Drawing Sheets

(56) References Cited

U.S. PATENT DOCUMENTS

| | | | | |
|---|---|---|---|---|
| 4,107,857 | A | 8/1978 | Devlin | |
| 4,535,554 | A | 8/1985 | De Obaldia B. | |
| D293,968 | S | 2/1988 | Baungratz | |
| 5,425,186 | A * | 6/1995 | Hoyt | 36/97 |
| 5,600,901 | A * | 2/1997 | Leonor | 36/7.1 R |
| 5,771,610 | A | 6/1998 | McDonald | |
| D460,605 | S | 7/2002 | Whittington | |
| 6,505,424 | B2 | 1/2003 | Oorei et al. | |
| 6,568,101 | B1 * | 5/2003 | Jansen et al. | 36/7.3 |
| 6,574,888 | B2 * | 6/2003 | Miller et al. | 36/97 |
| 6,701,643 | B2 * | 3/2004 | Geer et al. | 36/97 |
| 6,701,644 | B2 | 3/2004 | Oorei et al. | |
| 6,836,977 | B2 * | 1/2005 | Larson et al. | 36/59 R |
| 7,350,321 | B2 | 4/2008 | Soon et al. | |
| D576,397 | S | 9/2008 | Couder | |
| 7,818,900 | B2 * | 10/2010 | Cavasin | 36/97 |
| 2004/0211090 | A1 | 10/2004 | Miller et al. | |
| 2005/0229428 | A1 | 10/2005 | Holcomb | |
| 2006/0048407 | A1 | 3/2006 | Seamans | |
| 2006/0048413 | A1 | 3/2006 | Sokolowski et al. | |
| 2006/0283042 | A1 | 12/2006 | Greene et al. | |
| 2007/0022627 | A1 | 2/2007 | Sokolowski et al. | |
| 2007/0113424 | A1 | 5/2007 | Bell | |
| 2007/0180730 | A1 | 8/2007 | Greene et al. | |
| 2007/0256329 | A1 | 11/2007 | Antonelli et al. | |
| 2009/0071041 | A1 | 3/2009 | Hooper | |
| 2009/0229144 | A1 * | 9/2009 | Sussman | 36/97 |
| 2010/0058615 | A1 * | 3/2010 | Couder | 36/62 |

FOREIGN PATENT DOCUMENTS

| | | |
|---|---|---|
| WO | WO2008/155785 | 12/2008 |
| WO | 2010027465 | 3/2010 |

OTHER PUBLICATIONS

Invitation to Pay Additional Fees and International Search Report mailed Dec. 3, 2010 in International Application No. PCT/US2010/041911.

International Preliminary Report on Patentability (including Written Opinion of the ISA) mailed Feb. 23, 2012 in International Application No. PCT/US2010/041911.

Extended European Search Report dated Sep. 2, 2014 in European Patent Application No. 12163919.9.

Communication to Correct Deficiencies dated Sep. 1, 2014 in European Patent Application No. 10 735 122.3.

* cited by examiner

ARTICLE OF FOOTWEAR ACCOMMODATING DIFFERENT FOOT SIZES

BACKGROUND

The present invention relates generally to an article of footwear, and in particular to an article of footwear that accommodates different foot sizes.

Articles of footwear for sports like soccer tend to be expensive due to the use of various different types of materials that must be manufactured and assembled. Additionally, articles must be manufactured for each distinct footwear half size that further increases manufacturing costs. There is a need for articles that address the limitations of the related art.

SUMMARY

In one aspect, the invention provides an article of footwear, comprising: an upper and a sole; the sole comprising a plurality of cleat members that are integrally formed on an outer portion of the sole; the upper being made of a first material; the sole being made of a second material; the plurality of cleat members being made of a third material; and wherein the first material is substantially similar to the second material and wherein the second material is substantially similar to the third material.

In one aspect, the invention provides An article of footwear, comprising: an upper and a sole; the sole comprising an inner portion and an outer portion; the outer portion including a plurality of cleat members that are integrally formed with the sole; the inner portion including a plurality of cushioning members that are integrally formed with the sole; and wherein the plurality of cleat members and the plurality of cushioning members are made of a substantially similar material.

In one aspect, the invention provides An article of footwear, comprising: an upper and a sole; the article of footwear having a first configuration associated with a first length and a second configuration associated with a second length, the second length being greater than the first length; a groove disposed on the article of footwear; and wherein the groove is configured to assist the article of footwear in stretching between the first configuration and the second configuration.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
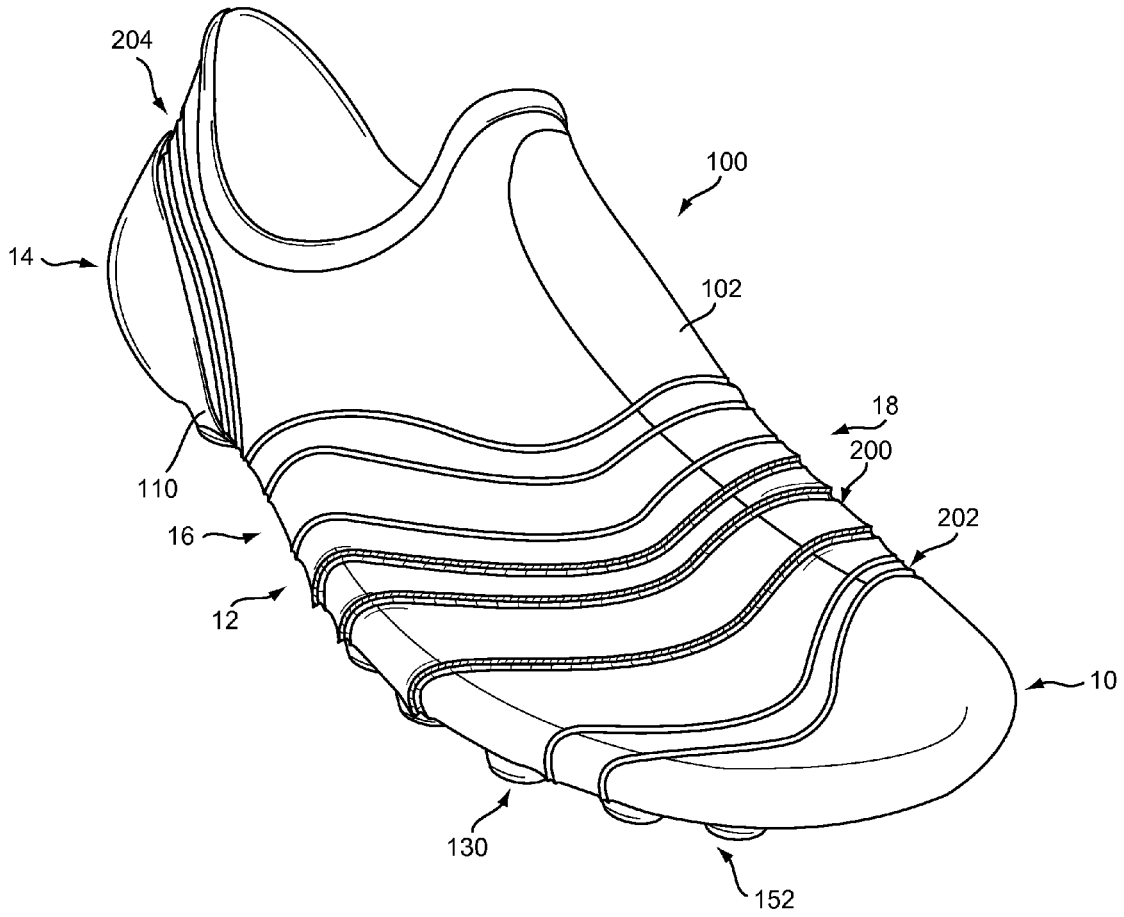
FIG. 1 is an isometric view of an embodiment of an article of footwear.

FIGS. 1 through 4 illustrate views of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 through 4, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 4, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102 and sole 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In an exemplary embodiment, upper 102 may be a low top upper configured for a soccer, or football, shoe. The low top upper may include a throat opening configured to receive a foot of a wearer that includes a top edge of upper 102 that defines a perimeter around the throat opening. In addition, the upper 102, including a low top upper or a high top upper, may be configured to extend over and completely cover the instep of a foot of a wearer.

In some embodiments, sole 110 may be configured to provide traction for article 100. In addition to providing traction, sole 110 may attenuate ground reaction forces when compressed between the foot and the ground during walking, running or other ambulatory activities. The configuration of sole 110 may vary significantly in different embodiments to include a variety of conventional or non-conventional structures. In some cases, the configuration of sole 110 can be configured according to one or more types of ground surfaces on which sole 110 may be used. Examples of ground surfaces include, but are not limited to: natural turf, synthetic turf, dirt, as well as other surfaces.

A sole can include provisions for increasing traction with a ground surface such as natural grass, synthetic grass or other surfaces. In some cases, a sole may include cleat members to enhance traction with the ground. The term "cleat members" as used in this detailed description and throughout the claims includes any provisions disposed on a sole for increasing traction through penetration of a ground surface. Cleat members may be configured for football, soccer, baseball or any type of activity that requires traction.

In the current embodiment, outer portion 120 of sole 110 comprises plurality of cleat members 130. Generally, plurality of cleat members 130 can include any number of cleat members. In some embodiments, plurality of cleat members 130 can comprise two or more cleats. In some cases, plurality of cleat members 130 can comprise a number of cleat members in the range between 5 and 10 cleat members. In other cases, plurality of cleat members 130 can comprise a number of cleat members in the range between 10 and 25 cleat members. In one embodiment, plurality of cleat members 130 can comprise 23 cleat members. In other embodiments, however, plurality of cleat members 130 could comprise more than 25 cleat members.

In different embodiments, plurality of cleat members 130 may be associated with sole 110 in any manner. In some embodiments, plurality of cleat members 130 may be screwed into holes within sole 110. In an exemplary embodiment, plurality of cleat members 130 may be integrally formed with sole 110. For example, in cases where sole 110 is formed by a molding process, plurality of cleat members 130 may be formed simultaneously with sole 110 during the molding process. This arrangement can help reduce the tendency of cleat members to break away from a sole and may therefore help improve durability of an article.

Plurality of cleat members 130 can be provided on any portion of outer portion 120 of sole 110. In some cases, plurality of cleat members 130 can be provided on forefoot portion 10. In other cases, plurality of cleat members 130 can be provided on midfoot portion 12. In still other cases, plurality of cleat members 130 can be provided on heel portion 14. In an exemplary embodiment, plurality of cleat members 130 can be provided on forefoot portion 10, midfoot portion 12 and heel portion 14.

In one embodiment, plurality of cleat members 130 may comprise first cleat members set 152 and second cleat member set 154. In some cases, first cleat member set 152 may be disposed on forefoot portion 10 and some portions of midfoot portion 12. Likewise, second cleat member set 154 may be disposed on heel portion 14 and some portions of midfoot portion 12. This arrangement provides for enhanced traction for article 100 on forefoot portion 10 and heel portion 14, as well as for some portions of midfoot portion 12.

Figure 4:
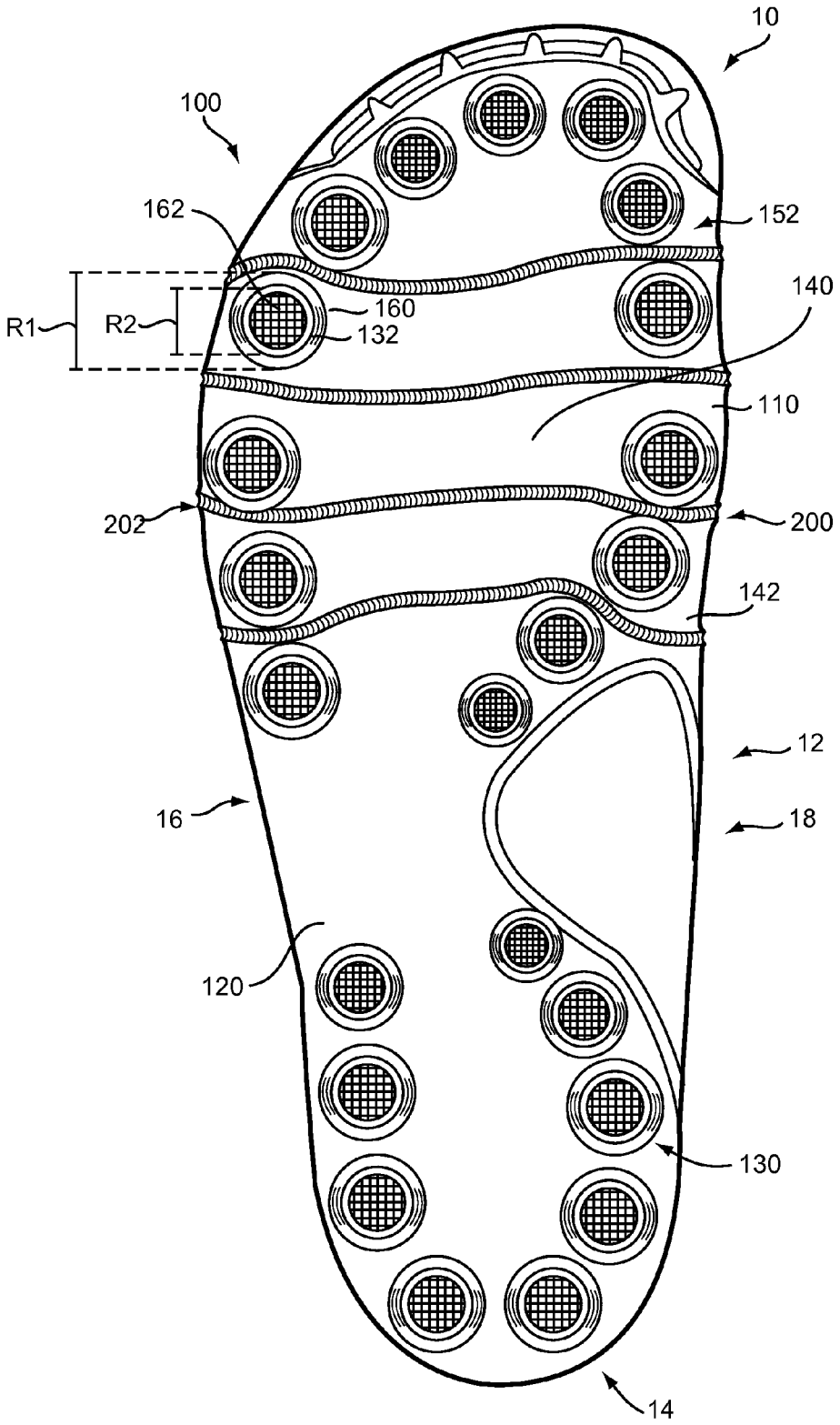
FIG. 4 is a plan view of an embodiment of a sole of an article of footwear.

In different embodiments, plurality of cleat members 130 can be configured in any arrangement on sole 110. In some embodiments, plurality of cleat members 130 can be regularly distributed around outer portion 120 of sole 110. In other embodiments, plurality of cleat members 130 can be distributed in other arrangements on outer portion 120. In some cases, for example, plurality of cleat members 130 can be disposed on central portion 140 of outer portion 120. In other cases, plurality of cleat members 130 can be disposed on outer peripheral portion 142, which is disposed outwardly from central portion 140. In an exemplary embodiment, a majority of plurality of cleat members 130 can be disposed on outer peripheral portion 142, as seen in FIG. 4.

Figure 2:
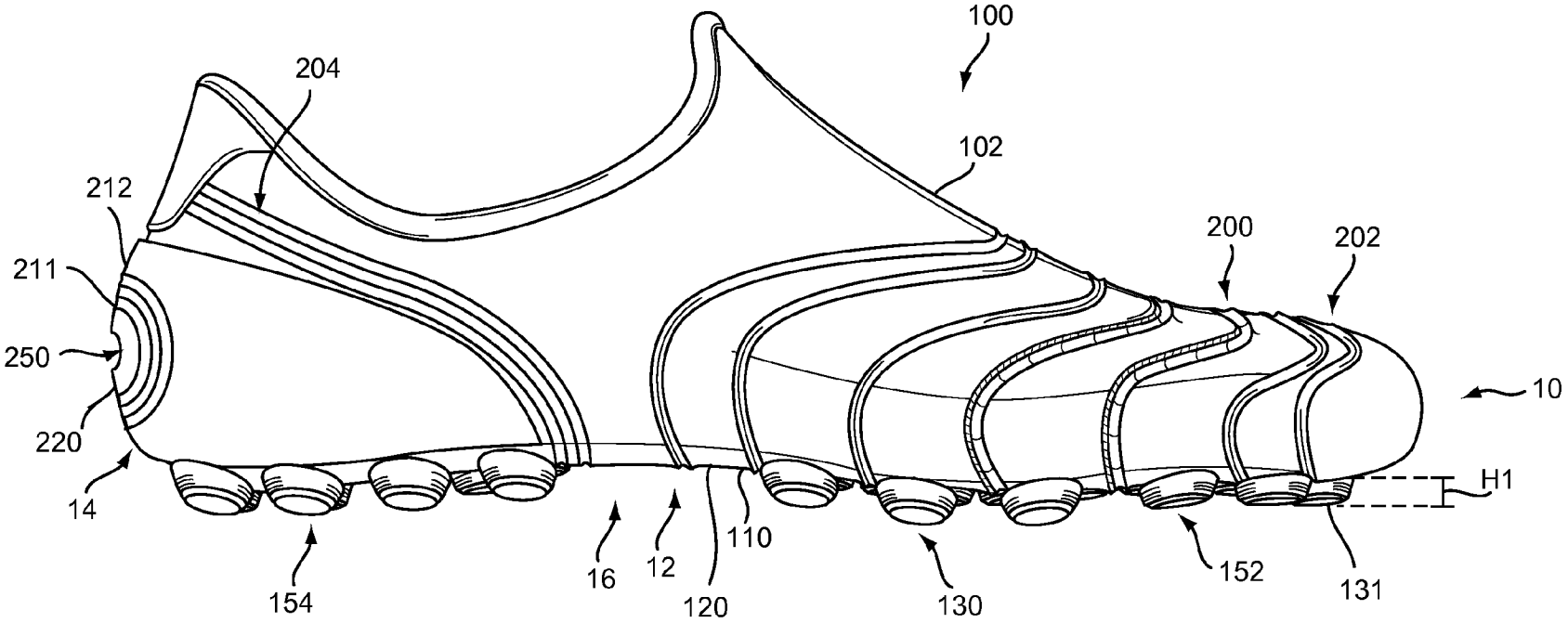
FIG. 2 is a side view of an embodiment of an article of footwear.
Figure 3:
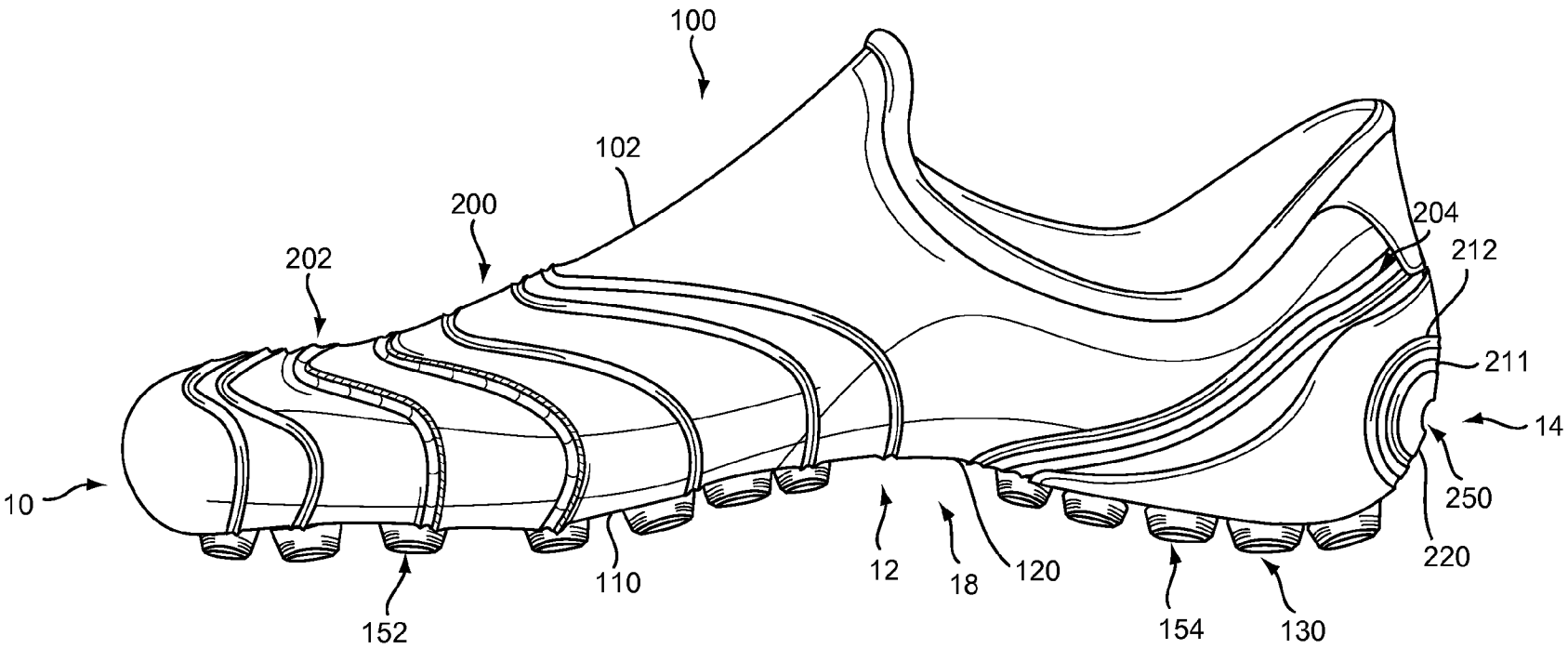
FIG. 3 is a side view of an embodiment of an article of footwear.

In some embodiments, the height of one or more cleat members can vary. In the current embodiment, first cleat member 131 may be associated with height H1, as seen in FIG. 2. In some cases, the value of height H1 can vary in the range between 1 mm and 10 mm. In other cases, the value of height H1 can be less than 1 mm. In still other cases, the value of height H1 can be greater than 10 mm. In one embodiment, the value of height H1 can vary in the range between 2 mm and 6 mm. In an exemplary embodiment, the value of height H1 can vary in the range between 4 mm and 6 mm. Furthermore, in some embodiments, the height of each cleat member of plurality of cleat members 130 can be similar to height H1. In other embodiments, the height of each cleat member of plurality of cleat members 130 can vary substantially from height H1. In an exemplary embodiment, the height of each cleat member of plurality of cleat members 130 can have a value in the range between 4 mm and 8 mm. With this arrangement, plurality of cleat members 130 can be configured to provide sufficient penetration into a ground surface in order to enhance the traction properties of sole 110.

In different embodiments, the geometry of one or more cleat members can vary. In some embodiments, each cleat member of plurality of cleat members 130 can be associated with any shape including, but not limited to: oblate spheroid, cubic, tetrahedral, polyhedral, cylindrical, conical, truncated conical, as well as any other shape. In one embodiment, each cleat member of plurality of cleat members 130 may be associated with a truncated conical shape. In other embodiments, however, different cleat members within plurality of cleat members 130 could be associated with different geometries.

In different embodiments, the radial sizes of one or more cleat members could vary. In the current embodiment, for example, base portion 160 of second cleat member 132 may have radius R1, while tip portion 162 of second cleat member 132 may have radius R2. In some cases, radius R1 may have a value that varies in the range between 1 mm and 10 mm. In other cases, radius R1 may have a value that varies in the range between 3 mm and 8 mm. Additionally, in some cases, radius R2 may have a value that varies in the range between 1 mm and 10 mm. In other cases, radius R2 may have a value that varies in the range between 3 mm and 8 mm. In an exemplary embodiment, radius R1 may have a value that is substantially larger than radius R2. Furthermore, it will be understood that in other embodiments the radial sizes of each cleat member of plurality of cleat members 130 can have values that are substantially similar to the radial sizes of second cleat member 132. In other embodiments, however, some cleat members of plurality of cleat members 130 can have different radial sizes from second cleat member 132. For example, in the current embodiment, the radial sizes of various cleat members of plurality of cleat members 130 may vary.

An article of footwear can include provisions for increasing durability of the article at reduced manufacturing costs. In some embodiments, each component of the article can be made of a substantially similar durable material. In some cases, the upper can be made of a first material and the sole can be made of a second material that is substantially similar to the first material. In addition, in some cases, a plurality of cleat members can be made of a third material that is substantially similar to the second material. In other words, the upper, the sole and the plurality of cleat members can comprise a substantially monolithic portion comprising a single material to enhance durability for the article and facilitate ease of manufacturing.

In the current embodiment, upper 102 may be made of a first material. In addition, sole 110 may be made of a second material. In some cases, the first material can be different from the second material. In an exemplary embodiment, the first material can be substantially similar to the second material. In particular, the material properties including, but not limited to: rigidity, durability and elasticity, may be substantially similar between the first material and the second material.

In some embodiments, plurality of cleat members 130 may be made of a third material. In some cases, the third material can be different from the second material of sole 110. In an exemplary embodiment, however, the third material can be substantially similar to the second material. In particular, the material properties including, but not limited to: rigidity, durability and elasticity, may be substantially similar between the third material and the second material. Furthermore, in some embodiments, the third material can also be substantially similar to the first material.

Using this arrangement, upper 102, sole 110 and plurality of cleat members 130 can provide substantially similar durability for article 100. Moreover, in some cases, upper 102, sole 110 and plurality of cleat members 130 can comprise a substantially monolithic material that extends throughout a substantial entirety of article 100. This arrangement allows for the material characteristics of the entirety of article 100 to be controlled more easily over traditional footwear that use distinct materials for the sole, upper and cleats.

Article 100 can be constructed from various materials. Examples of different materials that can be used include, but are not limited to: elastomers, siloxanes, natural rubber, other synthetic rubbers, natural leather, synthetic leather, nylon, foams, or plastics. In one embodiment, each of upper 102, sole 110 and plurality of cleat members 130 are associated with a single monolithic portion comprising a rubber material, which provides increased durability as well as some flexibility for article 100.

An article can include provisions for accommodating different foot sizes. In some embodiments, an article can be made of a substantially flexible material that is configured to stretch and accommodate different foot sizes. In other embodiments, an article can include stretch enhancing features. For example, in one embodiment, an article can include one or more grooves that are configured to assist stretching an article so that the article can expand to accommodate different foot sizes.

In some embodiments, article of footwear 100 can be provided with a groove system. A groove system can comprise one or more grooves disposed on a portion of an article. In some cases, a groove system can include a single groove. In other cases, a groove system can comprise two or more grooves. In an exemplary embodiment, a groove system can comprise a plurality of grooves that extend over multiple portions of an article.

Groove system 200 can be associated with any portions of article 100. In some cases, groove system 200 may extend through upper 102. In other cases, groove system 200 may extend through sole 110. In an exemplary embodiment, groove system 200 may extend through both upper 102 and sole 110.

In the current embodiment, article 100 can comprise groove system 200. Groove system 200 may further include first grove set 202 and second groove set 204. First groove set 202 may be generally associated with forefoot portion 10. In addition, first groove set 202 can include some grooves that extend to midfoot portion 12. Second groove set 204 may be generally associated with heel portion 14.

In different embodiments, the number of grooves comprising first groove set 202 can vary. In some cases, first groove set 202 can comprise between 1 and 12 grooves. In other cases, first grove set 202 can comprise more than 12 grooves. In an exemplary embodiment, first groove set 202 can include 7 grooves. Additionally, in different embodiments, the number of grooves comprising second groove set 204 can vary. In some cases, second grove set 204 can comprise between 1 and 8 grooves. In other cases, second groove set 204 can comprise more than 8 grooves. In an exemplary embodiment, second groove set 204 can comprise 4 grooves.

Generally, grooves in first groove set 202 can be arranged in any manner on article 100. In some cases, grooves in first groove set 202 can be arranged in an approximately linear manner on article 100. In other cases, grooves in first groove set 202 can be arranged in an approximately nonlinear manner on article 100. In an exemplary embodiment, grooves in first groove set 202 may be arranged in a substantially wave-like arrangement on upper 102 and sole 110. Furthermore, grooves in first groove set 202 may extend over article 100 in an approximately lateral direction. With this arrangement, first groove set 202 may be configured to assist in longitudinal stretching of forefoot portion 10 in order to accommodate different foot sizes.

Grooves in second groove set 204 can also be arranged in any manner on article 100. In some cases, grooves in second groove set 204 can be arranged in an approximately linear manner on article 100. In other cases, grooves in second groove set 204 can be arranged in an approximately nonlinear manner on article 100. In an exemplary embodiment, grooves in second groove set 204 can be arranged in a nonlinear manner on heel portion 14. In particular, in one embodiment, grooves in second groove set 204 can be arranged in a manner that conforms to the natural contouring of the heel.

In some embodiments, second groove set 204 can include grooves that are shaped to accommodate stretching of a rearward end of a heel. In one embodiment, second groove set 204 can comprise first ring groove 211 and second ring groove 212, which are provided on rearward portion 220 of heel portion 14. As a heel is inserted into article 100, first ring groove 211 and second ring groove 212 may expand in a manner that accommodates radially outward stretching of rearward portion 220. With this arrangement, second groove set 204 may be configured to assist in the stretching of heel portion 14 in order to accommodate different foot sizes.

In addition, in some embodiments, rearward portion 220 may be provided with hole 250. In some cases, hole 250 can further facilitate radially outward stretching at rearward portion 220 in order to help heel portion 14 stretch to accommodate the shape of the heel. Furthermore, as discussed above, first ring groove 211 and second ring groove 212 may further accommodate stretching around hole 250 to help rearward portion 220 stretch to conform to the shape of the heel. In other embodiments, however, rearward portion 220 may not include hole 250.

As discussed above, groove system 200 can include grooves that extend through both upper 102 and sole 110. For example, in the current embodiment, some grooves of first groove set 202 may extend around both upper 102 and sole 110 in a generally lateral direction. In this case, four of the grooves of first groove set 202 extend from upper 102 and across outer portion 120 of sole 110, as seen in FIG. 4. In other cases, any other number of grooves can extend around both upper 102 and sole 110.

Using this arrangement, groove system 200 can help assist in stretching for article 100. In particular, groove system 200 can help article 100 to stretch in a manner to accommodate multiple different shoe sizes. Moreover, since the material thickness of article 100 may be substantially thinner at each groove of groove system 200, these regions of upper 100 may be configured to stretch more than other regions of article 100 that do not include grooves.

Figure 5:
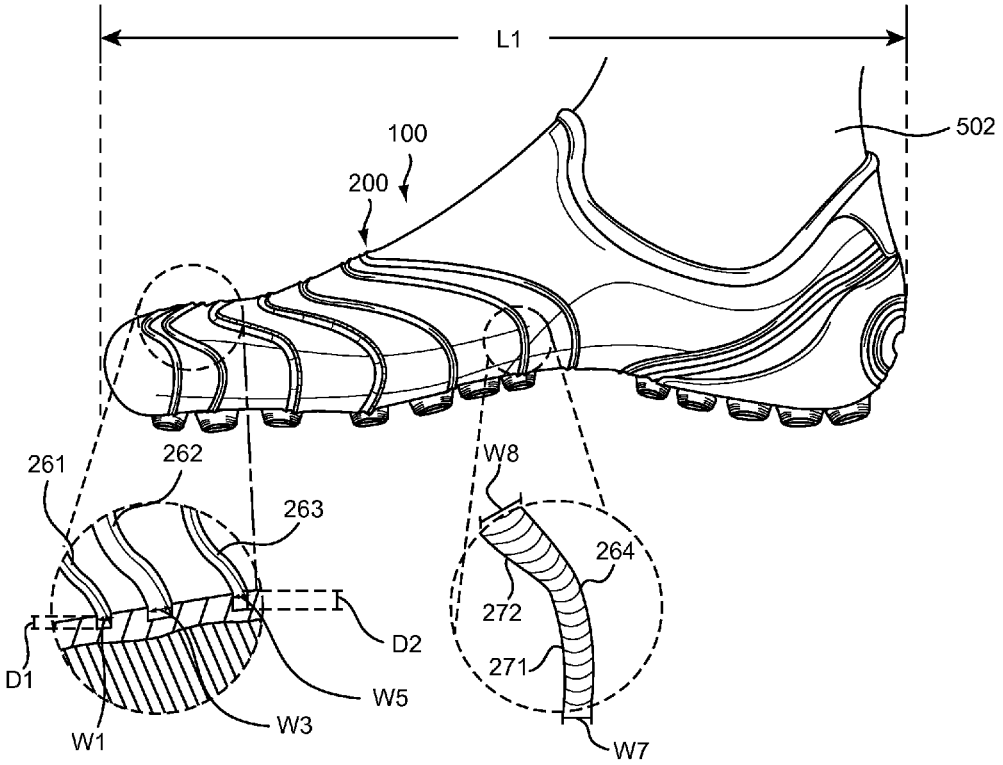
FIG. 5 is a side view of an embodiment of an article of footwear receiving a foot of a first size.

FIG. 5 illustrates an embodiment of article 100 receiving first foot 502. In this case, first foot 502 has a first size. In this embodiment, article 100 has a first configuration as article 100 accommodates the first foot size. In particular, article 100 has a first length L1 associated with the first configuration.

Figure 6:
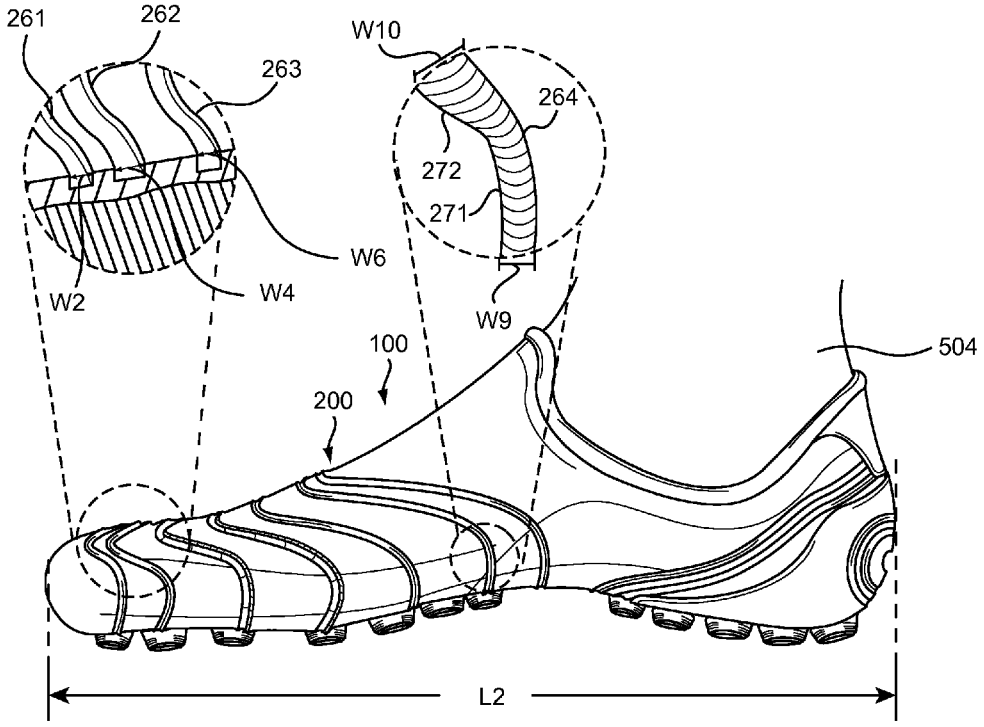
FIG. 6 is a side view of an embodiment of an article of footwear receiving a foot of a second size.

FIG. 6 illustrates an embodiment of article 100 receiving second foot 504, which has a second foot size. In this embodiment, the second foot size is greater than the first foot size. For example, in one embodiment, the first foot size may be a foot associated with an 11.5 c footwear size. In contrast, the second foot size may be a foot associated with a 12 c footwear size. Furthermore, article 100 has a second configuration as article 100 accommodates the second foot size. In particular, article 100 has a second length L2 associated with the second configuration. In an exemplary embodiment, second length L2 is greater than first length L1.

Although the current embodiment illustrates the change in length of article 100 between the first configuration and the second configuration, it will be understood that other dimensions of article 100 may also change between the first configuration and the second configuration. For example, the width of article 100 at different regions of article 100 may vary between the first configuration and the second configuration. Additionally, the height of article 100 at different regions can vary between the first configuration and the second configuration.

Referring to FIGS. 5 and 6, groove system 200 can help facilitate stretching between the first configuration and the second configuration. For example, first groove 261 may have width W1 when article 100 is in the first configuration. However, to accommodate second foot 504, which is larger than first foot 502, first groove 261 may expand to a width W2. In a similar manner, the widths of other grooves of groove system 200 may expand to accommodate second foot 504. This allows article 100 to stretch in a manner to comfortably fit second foot 504.

In different embodiments, two or more grooves of a groove system can be configured to stretch by different amounts. Generally, the degree of stretching a groove provides can be modified by varying the geometry of the groove. In some embodiments, the depth of one or more grooves can be varied to accomplish different amounts of stretching. In other embodiments, the widths of one or more grooves can be varied to accomplish different amounts of stretching. In still other embodiments, the geometry and size of one or more grooves can be varied in other ways to accomplish different amounts of stretching.

For example, in one embodiment, second groove 262 may have a width W3 that is slightly larger than width W1 of first groove 261 when article 100 is in the first configuration associated with the first length L1. By providing a greater width for second groove 262, second groove can be configured to undergo more stretching than first groove 261 when article 100 is in the second configuration associated with length L2. In particular, in the second configuration of article 100, second groove 262 may have a width W4 that is substantially larger than width W2 of first groove 261 in the first configuration. In other words, second groove 262 may undergo a greater amount of stretching than first groove 261. In particular, in some cases, the ratio of W4 over W3 may be greater than the ratio of W2 to W1.

In some embodiments, the depth of a groove can be varied to accomplish different amounts of stretching. For example, in this embodiment, first groove 261 may have a depth D1 when article 100 is in the first configuration. In addition, third groove 263 may have a depth D2 that is substantially larger than depth D1 when article 100 is in the first configuration. Furthermore, third groove 263 may have width W5 that is substantially similar to width W1 of first groove 261. However, as each groove expands in the second configuration of article 100, the greater depth of third groove 263 allows third groove 263 to stretch to width W6 that is substantially larger than width W2 of first groove 261 in the second configuration. This additional stretching of third groove 263 may occur since article 100 is thicker at first groove 261 than at third groove 263.

Additionally, differential stretching can occur over a single groove. In particular, different portions of a single groove can be configured to stretch by different amounts. In some embodiments, the geometry of a single groove can vary in a manner that provides different amounts of stretching at different portions of the groove. For example, in one embodiment, fourth groove 264 has a width W7 at first portion 271 and width W8 at second portion 272 in the first configuration of article 100. In this case, width W8 is greater than width W7. Furthermore, in the second configuration of article 100, fourth groove 264 stretches so that first portion 271 expands to a width W9 and second portion 272 expands to a width W10 so that width W9 is greater than width W7 and width W10 is greater than width W8. Also, second portion 272 may expand in a manner so that the ratio of width W10 to width W8 is greater than the ratio of width W9 to width W7. Using this arrangement, the geometry of each groove of groove system 200 can be varied in a manner to accomplish differential stretching so that article 100 can conform to the shape of different sized feet in a comfortable manner.

Figure 7:
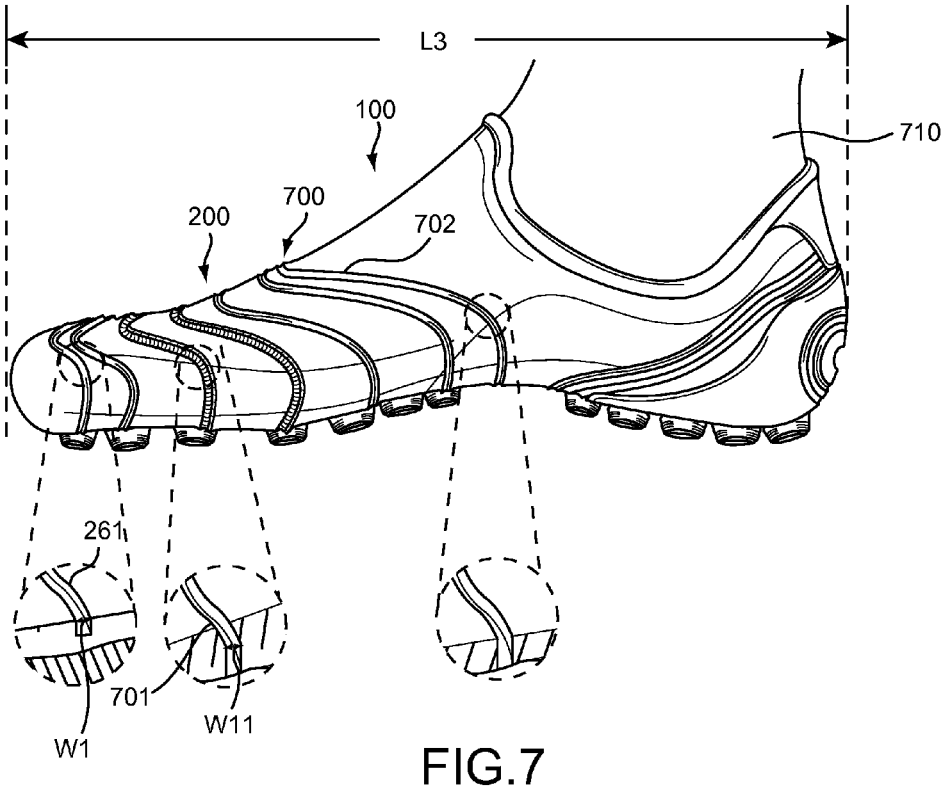
FIG. 7 is a side view of an embodiment of an article of footwear receiving a foot of a first size.
Figure 8:
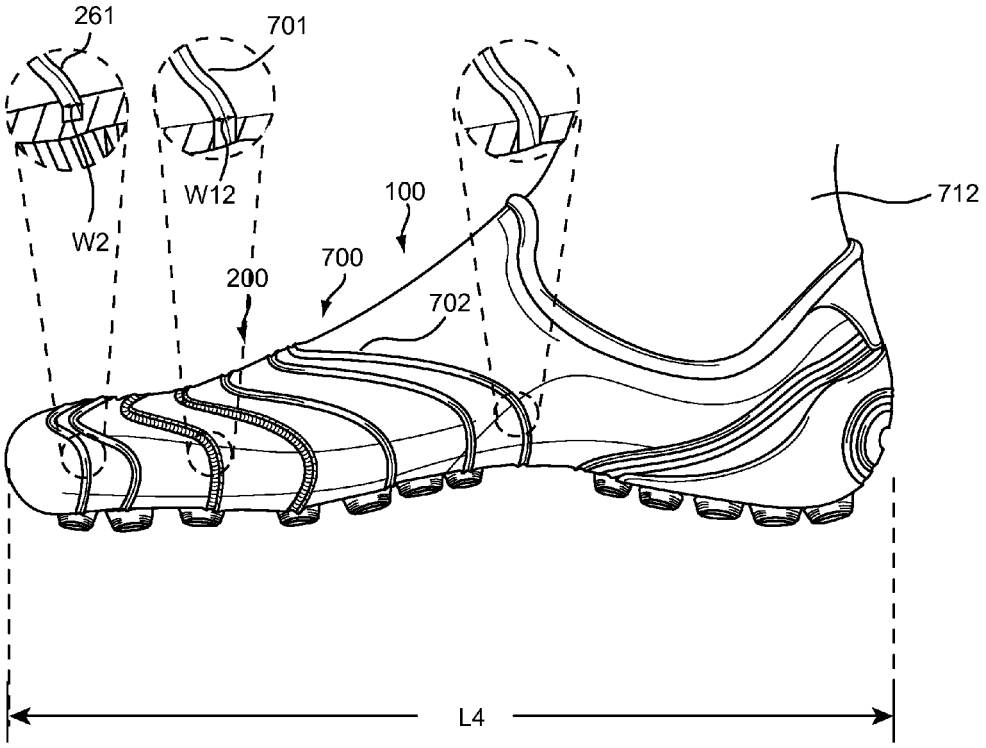
FIG. 8 is a side view of an embodiment of an article of footwear receiving a foot of a second size.

FIGS. 7 and 8 illustrate another embodiment of article 100. In this embodiment, groove system 200 is provided with plurality of perforations 700 as well as grooves. The term "perforation" as used throughout this detailed description and in the claims refers to a through-groove or slot that extends through the entire depth of a material layer and is open on the two opposing surfaces of the layer. For example, in this embodiment, plurality of perforations 700 includes first perforation 701 and second perforation 702. For purposes of clarity, only two perforations are shown in the current embodiments, however other embodiments could include more than two perforations. In still other embodiments, only one or two perforations could be used with an article of footwear.

Referring to FIG. 7, third foot 710 is inserted into article 100. In this case, article 100 is in a first configuration associated with length L3. In this case, first perforation 701 has a width W11 that is substantially equal to width W1 of first groove 261. As article 100 expands to a second configuration associated with length L4, first groove 261 expands to width W2, as discussed above. However, in this case, first perforation 701 expands to width W12 that is substantially greater than width W2, when fourth foot 712 is inserted into article 100. In other words, first perforation 701 is configured to stretch by a greater amount than first groove 261. Likewise, in some embodiments, second perforation 702 may be configured to stretch by greater amounts than the grooves of groove system 200.

Generally, the locations of perforations on upper 100 can vary. In some cases, perforations can be spaced at regular intervals. In other cases, perforations can be selectively applied to different locations of upper 100 so that the spacing between adjacent perforations in non-uniform. Also, perforations can be associated with upper 102 and/or sole 110. Furthermore, perforations can be applied to any portion of a shoe, including a forefoot portion, a midfoot portion and/or a heel portion.

By using combinations of grooves and perforations on article 100, the amount of stretching undergone by different portions of article 100 can be modified. In particular, by varying the geometry of the grooves and perforations, as well as the number and locations of the grooves and perforations, the stretching of article 100 can be fine-tuned to accommodate more than one size foot. Furthermore, in some embodiments, the use of perforations can provide for increased ventilation for article 100, since air can circulate through the perforations. Also, in some cases, perforations can provide regions of article 100, where moisture can escape, to help keep a foot dry.

For purposes of clarity, article 100 is illustrated in the current embodiments as stretching between a first configuration and a second configuration associated with two distinct footwear sizes. In other embodiments, however, an article can be configured to stretch over two or more footwear sizes. In one embodiment, an article can be configured to stretch over four footwear half sizes. For example, in an exemplary embodiment, a single article of footwear can be configured to accommodate four footwear half sizes including 11.5 c, 12 c, 12.5 c and 13 c. As another example, a single article of footwear can be configured to accommodate four footwear half sizes including 13.5 c, 1 y, 1.5 y and 2 y. In still another example, a single article of footwear can be configured to accommodate four footwear half sizes including 2.5 y, 3 y, 3.5 y and 4 y. In still another example, a single article of footwear can be configured to accommodate four footwear half sizes including 4.5 y, 5 y, 5.5 y and 6 y. Using these exemplary arrangements, four different articles can be manufactured that are configured to accommodate 16 different footwear half sizes.

In other embodiments, an article can be configured to stretch over any other number of footwear sizes or of footwear half sizes. For example, in another embodiment, an article can be configured to stretch over three footwear half sizes. In still another embodiment, an article can be configured to stretch over two footwear half sizes. In still other embodiments, an article can be configured to stretch over more than four footwear half sizes. Furthermore, it will be understood that the footwear sizes given above are only intended to be exemplary. In other embodiments, an article of footwear could be configured to accommodate multiple footwear sizes for adults, as well as for child or youth sizes. Additionally, an article can be configured to accommodate multiple footwear sizes for men and/or women.

An article of footwear can include provisions for enhancing cushioning for a bottom surface of a foot. In some embodiments, an article comprising a monolithic material can include an integrally formed cushioning system on an inner surface of the sole. In an exemplary embodiment, an inner surface of a sole can comprise cushioning members that are configured to receive a bottom surface of a foot to enhance cushioning, as well as increase ventilation and help reduce in shoe slipping.

Figure 9:
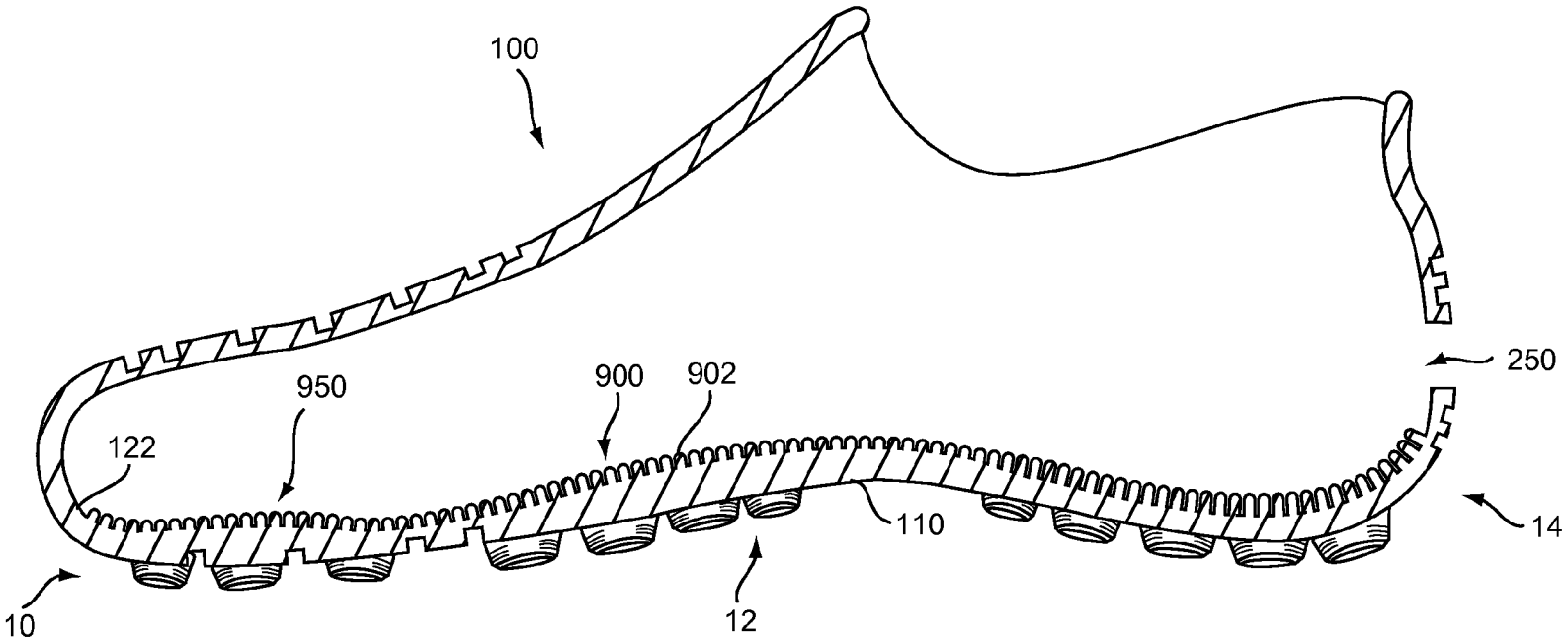
FIG. 9 is a side cross sectional view of an embodiment of an article of footwear.
Figure 10:
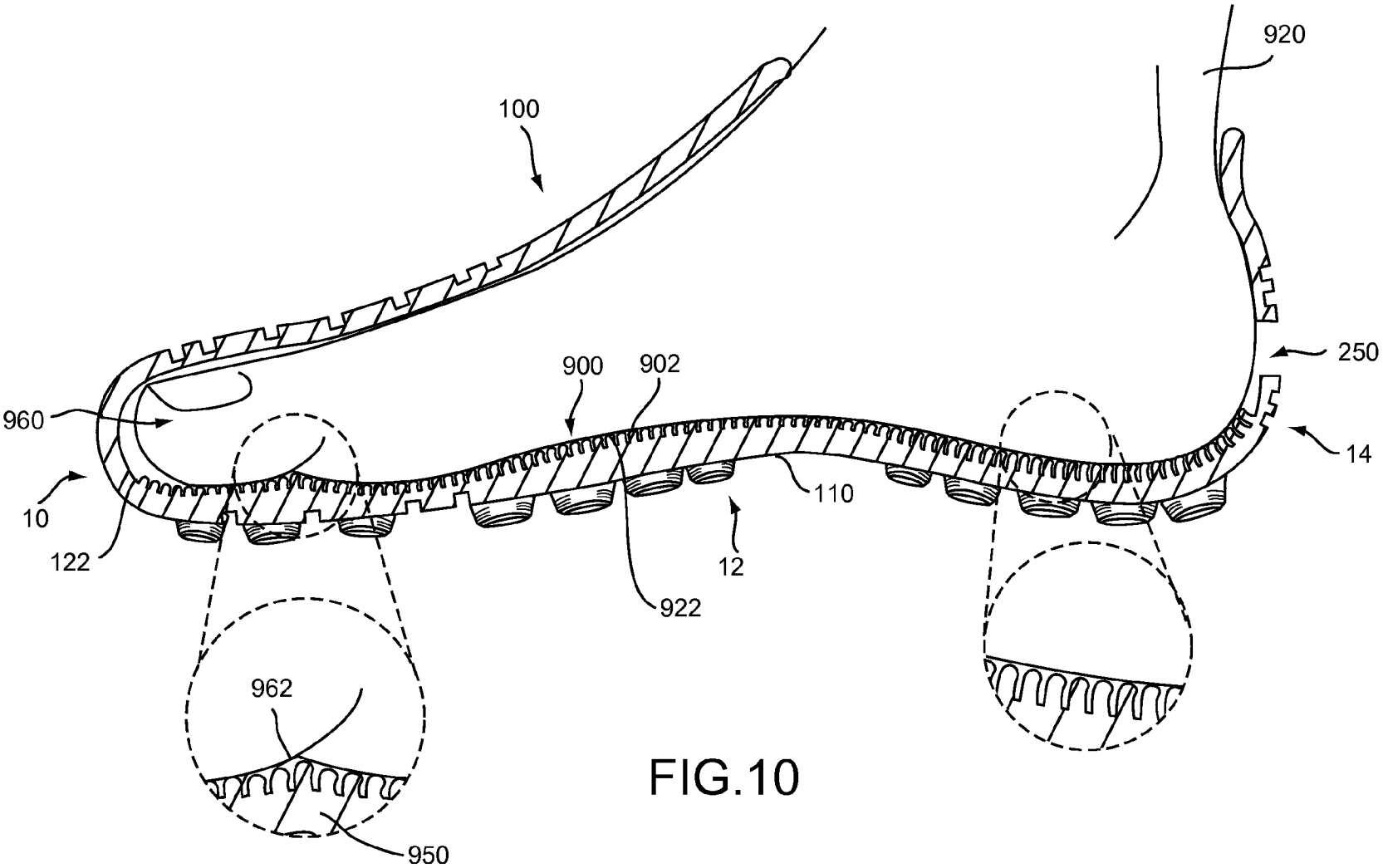
FIG. 10 is a side cross sectional view of an embodiment of an article of footwear.

FIGS. 9 and 10 illustrate cross-sectional views of article 100. Referring to FIGS. 9 and 10, article 100 can include internal cushioning system 900. In some embodiments, internal cushioning system 900 can be provided on inner portion 122 of sole 110. In other cases, internal cushioning system 900 could extend to an inner portion of upper 102. In an exemplary embodiment, internal cushioning system 900 may be provided on inner portion 122 to receive bottom surface 922 of foot 920.

Internal cushioning system 900 can be associated with various regions of sole 110. In some cases, internal cushioning system 900 can be provided on forefoot portion 10 of sole 110. In other cases, internal cushioning system 900 can be provided on midfoot portion 12 of sole 110. In still other cases, internal cushioning system 900 can be provided on heel portion 14 of sole 110. In an exemplary embodiment, internal cushioning system 900 can be provided on forefoot portion 10, midfoot portion 12 and heel portion 14 of sole 110. With this arrangement, internal cushioning system 900 can provide cushioning over an entirety of bottom surface 922 of foot 920.

In some embodiments, internal cushioning system 900 can comprise a plurality of cushioning members 902. Generally, cushioning members 902 can have any shape. Examples of different shapes include, but are not limited to: dome-like shapes, bristle-like shapes, nub-like shapes, as well as other types of shapes. In an exemplary embodiment, cushioning members 902 may have rounded bristle shapes.

In different embodiments, cushioning members 902 can be associated with various heights. In some embodiments, the heights of cushioning members 902 can vary in the range between 0.1 mm and 5 mm. In other embodiments, the heights of cushioning members 902 could be less than 0.1 mm. In still other embodiments, the heights of cushioning members 902 could be greater than 5 mm. Furthermore, in some embodiments, the heights of cushioning members 902 may vary over the length of sole 110. In an exemplary embodiment, the heights of cushioning members 902 in forefoot portion 10 may have values of approximately 2 mm. Also, the heights of cushioning members 902 in midfoot portion 12 may have values of approximately 1.5 mm. In addition, the heights of cushioning members 902 in heel portion 14 may have heights of approximately 3 mm.

A cushioning system can include provisions for facilitating comfort for a bottom surface of a foot. In some embodiments, an inner portion of a sole can have a contoured shape that corresponds to a bottom surface of a foot. In an exemplary embodiment, a cushioning system can include cushioning members that are provided on contoured portions of the sole.

In some embodiments, inner portion 122 of sole 110 may be contoured in a manner that corresponds to the shape of bottom surface 922 of foot 920. In one embodiment, inner portion 122 can include raised portion 950 that is disposed on forefoot portion 10. In some cases, raised portion 950 may be disposed on a portion of sole 110 that corresponds to a region of toe 960. In an exemplary embodiment, raised portion 950 may correspond to lower contour 962 of big toe 960 that is associated with a joint of big toe 960. Furthermore, raised portion 950 may include cushioning members 902 that are configured to further deform and fit comfortably against lower contour 962. With this arrangement, sole 110 can be contoured to a bottom surface of a foot in a manner that provides additional comfort and support. In addition, providing raised portion 950 can help prevent slip between a foot and sole 110, which may occur more easily in articles with flattened foot receiving surfaces.

In other embodiments, additional contoured portions can be provided on inner portion 122 of sole 110. In some cases, for example, lowered portions can be provided that receive protrusions of a foot, such as bony protrusions that may occur at joints between bones. In other cases, additional raised portions can be provided on inner portion 122 to provide a better fit for various regions of a foot. For example, in another embodiment, an article can include additional raised portions that are provided on an inner portion of a sole for fitting with contours of other toes, especially at joints of the toes.

In some embodiments, cushioning members 902 may be associated with a fourth material. In some cases, the fourth material can be a distinct material from the second material of sole 110. In other cases, however, the fourth material can be a substantially similar material to the second material. For example, in embodiments where sole 110 is made of a rubber material, internal cushioning system 900 can also be made of a substantially similar rubber material. With this arrangement, the durability of internal cushioning system 900 can be enhanced. Furthermore, the manufacturing cost for article 100 can be reduced over traditional internal cushioning systems that are manufactured separately and attached to a sole during assembly of the footwear. In some embodiments, for example, a mold used for making sole 110 can be configured for molding cushioning members 902 simultaneously with sole 110.

As illustrated in FIG. 10, cushioning members 902 may be configured to deform or bend under the weight of foot 920. This allows internal cushioning system 900 to better conform to the shape of bottom surface 922 of foot 920. In some cases, this also allows for increased surface area contact between bottom surface 922 and cushioning members 902 in order to enhance grip between inner portion 122 of sole 110 and foot 920.

Using the arrangement discussed above for cushioning system 900, the durability of article 100 can be increased, since cushioning system 900 is integrally formed with sole 110 and may comprise a substantially similar durable material. Furthermore, internal cushioning system 900 can provide increased air circulation beneath bottom surface 922 of foot 920. Likewise, the spacing provided beneath cushioning members 902 can help direct moisture and dirt away from bottom surface 922. This can help increase grip between bottom surface 922 and cushioning members 902 to help reduce in shoe slipping.

Figure 11:
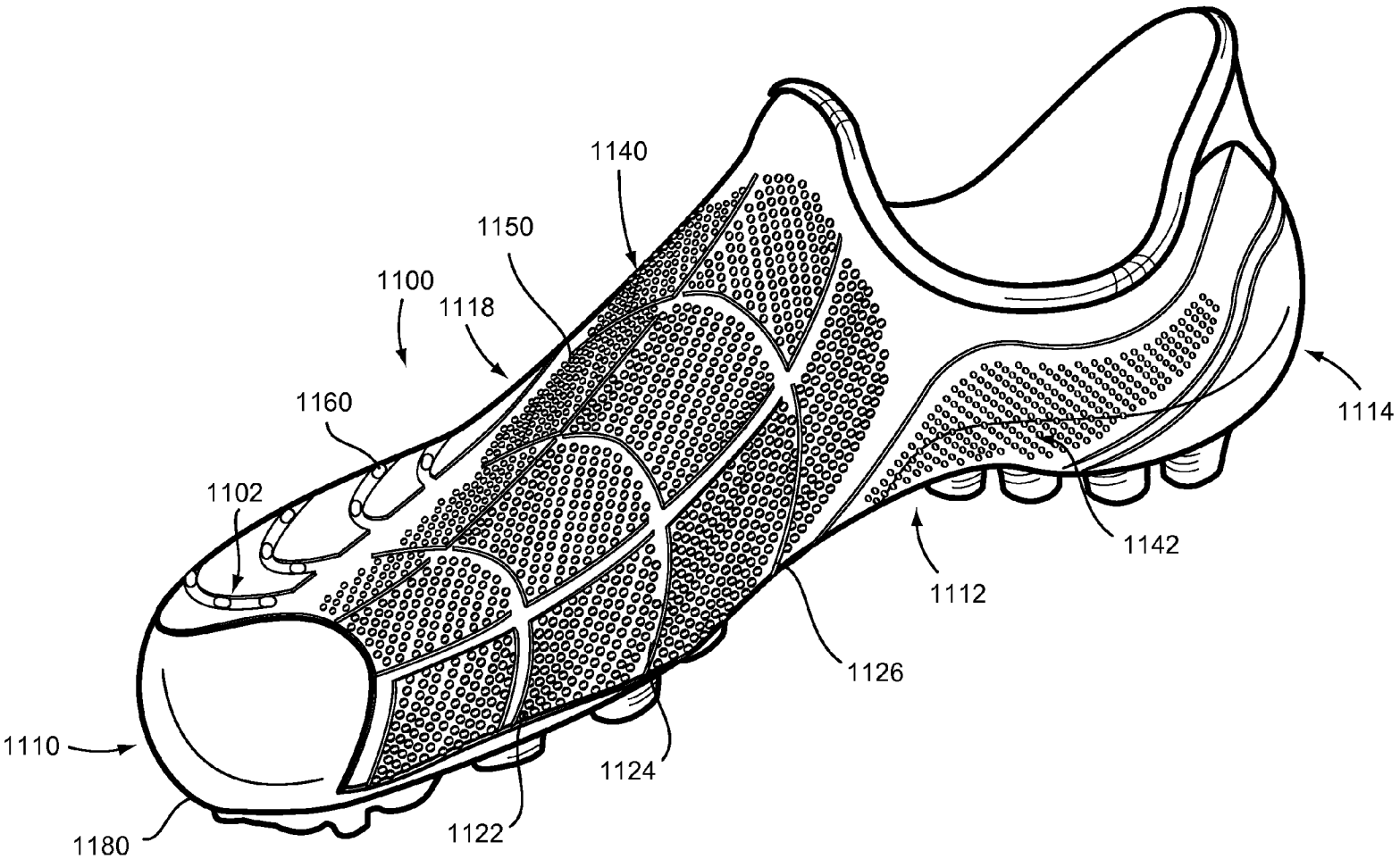
FIG. 11 is an isometric view of another embodiment of an article of footwear.
Figure 12:
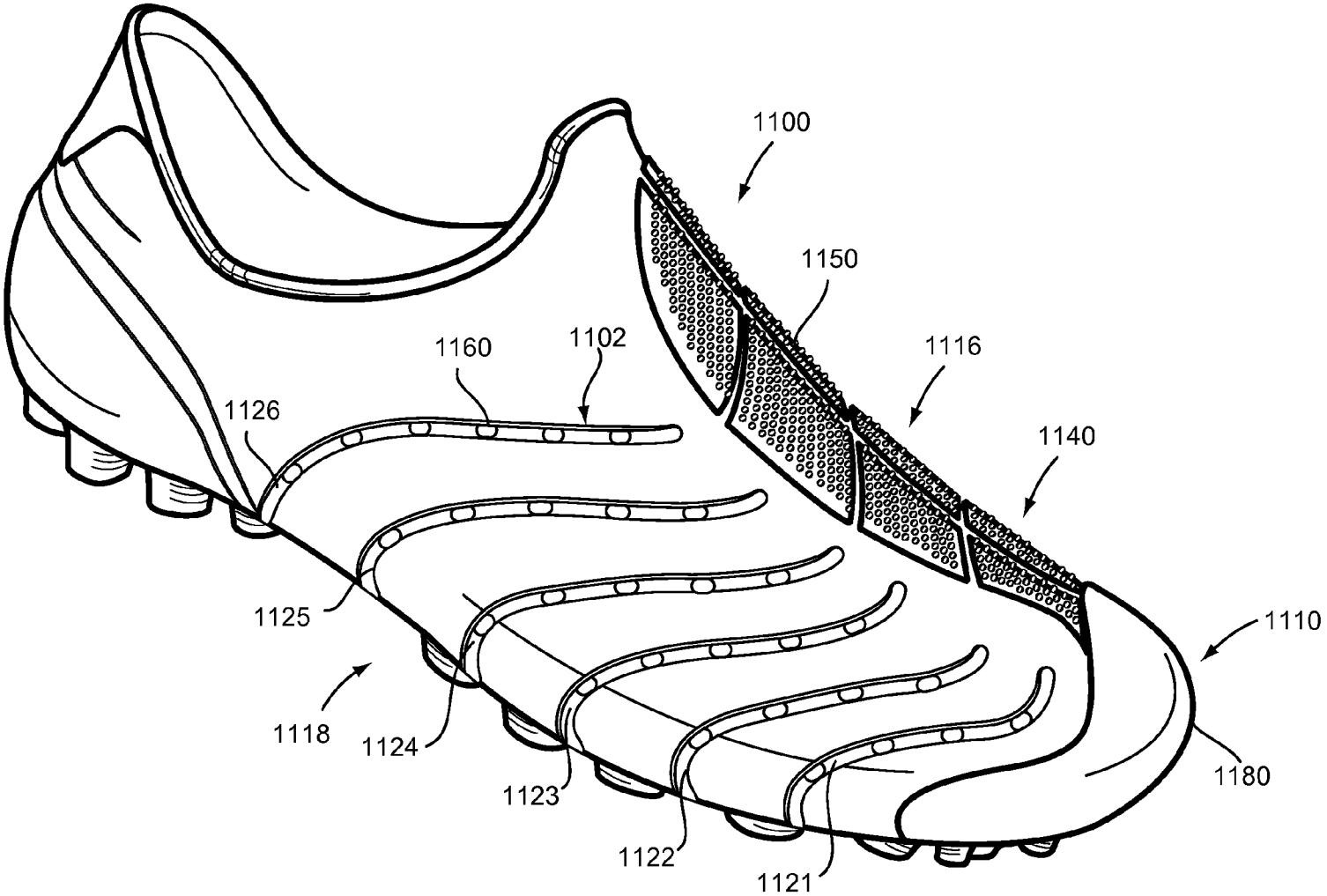
FIG. 12 is an isometric view of another embodiment of an article of footwear.

FIGS. 11 and 12 illustrate another embodiment of article of footwear 1100. Referring to FIGS. 11 and 12, article of footwear 1100 can have similar features to the previous embodiment discussed above. For example, article of footwear 1100 can be provided with plurality of grooves 1102 that are configured to accommodate stretching. In this embodiment, plurality of grooves 1102 may include six grooves, however in other embodiments any other number of grooves can be used. Plurality of grooves 1102 may comprise first groove 1121, second groove 1122, third groove 1123, fourth groove 1124, fifth groove 1125 and sixth groove 1126.

In this embodiment, plurality of grooves 1102 extend through lateral side 1118 of article 1100. In addition, some of plurality of grooves 1102 may extend through medial side 1116 of article 1100. In the current embodiment, second groove 1122, fourth grove 1124 and sixth groove 1126 extend through medial side 1116, while first groove 1121, third groove 1123 and fifth groove 1125 extend only on lateral side 1118. In other embodiments, only some of plurality of grooves 1102 may extend on lateral side 1118 as well. This arrangement may help to provide different levels of stretching on medial side 1116 and lateral side 1118 to improve fit.

Article 1100 may include provisions for enhancing grip with a ball, such as a soccer ball. In some embodiments, article 1100 can be provided with one or more textured portions that enhance grip between article 1100 and a ball. In some embodiments, textured portions can comprise a plurality of nub-like protrusions that extend from a surface of an article. In the current embodiment, article 1100 is provided with first textured portion 1140 and second textured portion 1142. First textured portion 1140 may be provided on medial side 1116 of forefoot portion 1110. In this embodiment, first textured portion 1140 may be divided into textured segments 1150 that are separated by plurality of flex grooves 1102. Second textured portion 1142 may be provided on medial side 1116 of midfoot portion 1112. With this arrangement, first textured portion 1140 and second textured portion 1142 can help increase grip with a ball for better kicking and/or passing control.

Although textured portions are provided on a medial side of article 1100 in the current embodiment, in other embodiments, textured portions could be provided on any other portion of an article. For example, in another embodiment, a textured portion could be disposed on a lateral side of an article. In still another embodiment, a textured portion could be disposed on a heel portion of an article.

In different embodiments, textured portions can comprise any material. In some embodiments, textured portions can comprise a similar material to the material used for an article. In other embodiments, textured portions can be made of a substantially different material from the material used to make an article. In one example, an article and textured portions may both be made of a material comprising rubber. In addition, textured portions can be integrally formed with an article or fastened to an article. In one example, textured portions can be formed during a molding process used to make an article of footwear.

An article of footwear with grooves can include provisions for increasing ventilation in an article of footwear. In some embodiments, one or more grooves can include vent holes that may provide increased ventilation for an article of footwear. In other embodiments, holes could be provided on other portions of an article.

In the current embodiment, article 1100 may include plurality of holes 1160 that are disposed within plurality of grooves 1102. In some cases, plurality of holes 1160 can be disposed on each groove of plurality of grooves 1102. In other cases, plurality of holes 1160 may only be disposed on some grooves of plurality of grooves 1102. In addition, in some cases, plurality of holes 1160 may only be associated with lateral side 1118 of article 1100. In other cases, plurality of holes 1160 may only be associated with medial side 1116 of article 1100. In still other cases, plurality of holes 1160 may be associated with both lateral side 1118 and medial side 1116 of article 1100. In an exemplary embodiment, plurality of holes 1160 may extend only through the portions of plurality of grooves 1102 on lateral side 1118. This arrangement may provide increased ventilation for article 1100 and reduce sweating, which can help prevent a foot from sliding within the interior of article 1100 and causing discomfort.

Generally, any number of holes can be used with one or more grooves of an article. In some cases, a single hole can be provided on each groove. In other cases, two or more holes can be provided on each groove. In still other cases, approximately four to six holes can be provided on each groove. Furthermore, in some cases each groove may be provided with a substantially similar number of holes, while in other cases different grooves can be provided with a different number of holes. In some embodiments, the number and holes used for each groove can be selected to tune the ventilation properties for an article of footwear.

In some embodiments, article 1100 can include provisions to enhance durability in the region of the toes. In this embodiment, article 1100 includes toe portion 1180. In some cases, toe portion 1180 may be provided with increased rigidity over other portions of article 1100. In one embodiment, toe portion 1180 has a greater thickness than adjacent portions of article 1100. This arrangement can increase both rigidity and durability for article 1100 to help protect the toes during kicks.

Some embodiments may include one or more of the following features: grooves, perforations, and holes. Some embodiments may include all three of these features, while some embodiments may include none of these features. Different embodiments may include any combination of grooves, perforations, and holes. For example, in some embodiments, an article could include a plurality of grooves and plurality of perforations. Furthermore, one or more grooves could be configured with ventilation holes for further increasing ventilation throughout the article. In some embodiments, the ventilation and flexibility of an article could be simultaneously tuned by selectively applying perforations and grooves including holes to various portions of the article.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper and a sole;

the sole comprising an inner portion and an outer portion;

the outer portion including a plurality of cleat members that are integrally formed with the sole;

the inner portion including a plurality of cushioning members that are integrally formed with the sole, the plurality of cushioning members being exposed to an interior of the article of footwear;

at least one groove encircling the article of footwear and extending through the upper and the sole, wherein the groove expands to stretch the upper and the sole to accommodate a foot of a wearer;

wherein the plurality of cleat members and the plurality of cushioning members are made of a substantially similar material;

wherein the plurality of cushioning members are disposed along the inner portion of the sole such that the entirety of the plurality of cushioning members disposed on the inner portion of the sole form a contoured shape corresponding to a bottom surface of a foot; and wherein the contoured shape comprises a first set of the plurality of cushioning members having a first height and a second set of the plurality of cushioning members having a second height that is larger than the first height.

2. The article of footwear according to claim 1, wherein the plurality of cushioning members and the sole are made of a substantially similar material.

3. The article of footwear according to claim 2, wherein the plurality of cushioning members and the upper are made of a substantially similar material.

4. The article of footwear according to claim 1, wherein the plurality of cleat members and the sole are made of a substantially similar material.

5. The article of footwear according to claim 4, wherein the plurality of cleat members and the upper are made of a substantially similar material.

6. The article of footwear according to claim 1, wherein at least one of the plurality of cushioning members associated with the second set is disposed on the inner portion of the sole at a location that corresponds to a contour of a toe.

7. The article of footwear according to claim 1, wherein the at least one groove is disposed in a forefoot portion of the article of footwear.

8. The article of footwear according to claim 1, further comprising a plurality of grooves, including a first groove set disposed in a forefoot portion of the article of footwear extending through the upper and the sole and a second groove set disposed in a heel portion of the article of footwear extending through the upper and the sole.

9. The article of footwear according to claim 8, wherein the second groove set includes at least one groove extending from a midfoot portion of the sole and through the upper in a rearwards direction towards the heel portion.

10. An article of footwear, comprising:

an upper and a sole;

the sole comprising an inner portion disposed opposite an outer portion, the inner portion including a plurality of cushioning members that are integrally formed with the sole, the plurality of cushioning members being exposed to an interior of the article of footwear, and wherein the plurality of cushioning members are disposed over substantially all of the inner portion of the sole;

the article of footwear having a first configuration associated with a first length and a second configuration associated with a second length, the second length being greater than the first length;

a plurality of grooves disposed on the article of footwear and extending around the article of footwear in a lateral direction through the upper and the sole, wherein the plurality of grooves are disposed below an exterior surface of the article of footwear and extend around the article of footwear in a continuous manner from the upper to an underside of the sole;

the plurality of grooves including a first groove associated with a first width and a second groove associated with a second width, the first width being smaller than the second width; and wherein the first groove and the second groove are configured to assist the article of footwear in stretching between the first configuration and the second configuration.

11. The article according to claim 10, wherein the first configuration is associated with a first footwear size and wherein the second configuration is associated with a second footwear size that is a half size larger than the first footwear size.

12. The article of footwear according to claim 10, wherein the article of footwear is configured to accommodate four distinct footwear half sizes.

13. The article of footwear according to claim 10, wherein the upper and the sole comprise a substantially monolithic material.

14. The article of footwear according to claim 10, wherein at least one of the first groove and the second groove includes a plurality of perforations.

15. The article of footwear according to claim 14, wherein the plurality of perforations disposed within at least one of the first groove and the second groove extend through from an exterior surface to an interior of the article of footwear.

16. The article of footwear according to claim 10, wherein the article of footwear includes three or more grooves.

17. The article of footwear according to claim 10, wherein the plurality of grooves further includes a first groove set disposed in a forefoot portion of the article of footwear extending through the upper and the sole and a second groove set disposed in a heel portion of the article of footwear extending through the upper and the sole.

18. The article of footwear according to claim 17, wherein the second groove set includes at least one groove extending from a midfoot portion of the sole and through the upper in a rearwards direction towards the heel portion.

19. The article of footwear according to claim 10, wherein the plurality of cushioning members are associated with a height from 0.1 mm to 5 mm.

* * * * *